US008657628B2

(12) United States Patent
Xie

(10) Patent No.: US 8,657,628 B2
(45) Date of Patent: Feb. 25, 2014

(54) UNIVERSAL SERIAL BUS CONNECTOR

(75) Inventor: Ze-Liang Xie, Shenzhen (CN)

(73) Assignees: Hon Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/558,366

(22) Filed: Jul. 26, 2012

(65) Prior Publication Data

US 2014/0017939 A1 Jan. 16, 2014

(30) Foreign Application Priority Data

Jul. 13, 2012 (CN) ..... 2012 1 02423919

(51) Int. Cl.
*H01R 13/648* (2006.01)

(52) U.S. Cl.
USPC ..... 439/607.19; 439/607.23; 439/607.1

(58) Field of Classification Search
USPC ..... 361/816–818; 439/607.23–607.25, 439/607.01, 607.121, 607.19, 541.5
See application file for complete search history.

(56) References Cited

U.S. PATENT DOCUMENTS

| | | | | | |
|---|---|---|---|---|---|
| 4,708,412 | A * | 11/1987 | Himes et al. | ..... | 439/607.02 |
| 5,401,192 | A * | 3/1995 | Briones et al. | ..... | 439/607.35 |
| 5,766,041 | A * | 6/1998 | Morin et al. | ..... | 439/607.19 |
| 5,772,471 | A * | 6/1998 | Buck | ..... | 439/607.28 |
| 5,851,125 | A * | 12/1998 | Hsu et al. | ..... | 439/541.5 |
| 6,083,041 | A * | 7/2000 | Kuo | ..... | 439/553 |
| 6,211,457 | B1 * | 4/2001 | Cama et al. | ..... | 361/816 |
| 6,264,501 | B1 * | 7/2001 | Hung et al. | ..... | 439/541.5 |
| 6,346,009 | B1 * | 2/2002 | Lin | ..... | 439/607.01 |
| 6,595,801 | B1 * | 7/2003 | Gardner et al. | ..... | 439/607.55 |
| 6,699,074 | B1 * | 3/2004 | Wu et al. | ..... | 439/607.08 |
| 7,435,106 | B2 * | 10/2008 | Su et al. | ..... | 439/76.1 |
| 7,530,845 | B1 * | 5/2009 | Yang | ..... | 439/607.01 |
| 7,588,458 | B2 * | 9/2009 | He et al. | ..... | 439/541.5 |
| 8,506,324 | B2 * | 8/2013 | Naufel et al. | ..... | 439/541.5 |
| 2002/0048992 | A1 * | 4/2002 | Wang et al. | ..... | 439/607 |
| 2009/0311909 | A1 * | 12/2009 | Yu et al. | ..... | 439/607.23 |
| 2011/0312217 | A1 * | 12/2011 | Xiao et al. | ..... | 439/607.23 |

* cited by examiner

*Primary Examiner* — Briggitte R Hammond
(74) *Attorney, Agent, or Firm* — Altis Law Group, Inc.

(57) ABSTRACT

A universal serial bus (USB) connector includes a main body and a conductive member. The main body is fastened to an enclosure. The main body includes at least one USB interface. The conductive member includes an engaging portion for engaging with the main body and abutting against each housing of the at least one USB interface, and a connection tab abutting against the enclosure.

3 Claims, 3 Drawing Sheets

UNIVERSAL SERIAL BUS CONNECTOR

BACKGROUND

1. Technical Field

The present disclosure relates to a universal serial bus (USB) connector.

2. Description of Related Art

USB connectors are generally attached to a circuit board, and the circuit board is electrically connected to a motherboard through cables. For reducing cost, the circuit board is omitted, and the USB connectors are directly connected to the motherboard through cables. Without the filter circuit of the circuit board, electromagnetic radiation mainly generated by the cables cannot be effectively filtered out.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean "at least one".

Figure 1:
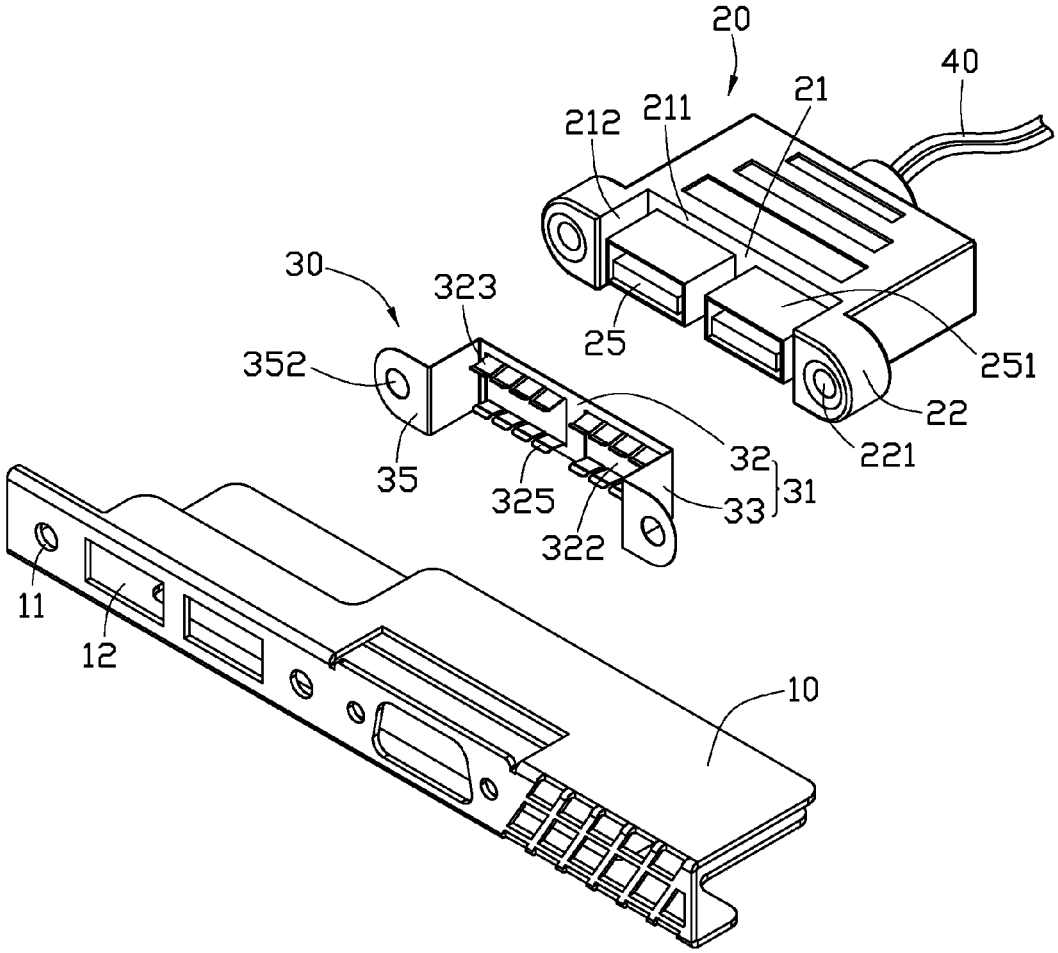
FIG. 1 is an exploded, isometric view of an exemplary embodiment of a universal serial bus (USB) connector together with an enclosure.

FIG. 1 shows an exemplary embodiment of a universal serial bus (USB) connector fastened to an enclosure 10 of an electronic device. The USB connector includes a main body 20 and a conductive member 30.

The enclosure 10 defines two through holes 11, and two openings 12 between the through holes 11.

The main body 20 includes two fastening portions 22 extending from a front side, and defines a slot 21 in the front side between the fastening portions 22. A locking hole 221 is defined in each fastening portion 22, extending in a fore-and-aft direction. The slot 21 includes a sidewall 211 and two end walls 212. Two USB interfaces 25 are connected to the sidewall 211. Cables 40 are connected to a rear side of the main body 20.

The conductive member 30 includes an engaging portion 31 and two connection tabs 35. The engaging portion 31 includes a base tab 32 and two extension tabs 33 perpendicularly extending forward from opposite ends of the base tab 32. The base tab 32 defines two rectangular openings 322. A plurality of resilient tabs 323 slantingly extends forward and down from a top side bounding each opening 322, and a plurality of resilient tabs 323 slantingly extends forward and up from a bottom side bounding each opening 322. A slanting tab 325 slantingly extends forward and up from a front end of each of the top resilient tabs 323, and a slanting tab 325 slantingly extends forward and down from a front end of each of the bottom resilient tabs 323, for enhancing resilience of the resilient tabs 323. The connection tabs 35 respectively extend from front sides of the extension tabs 33, away from each other. A through hole 352 is defined in each connection tab 35.

Figure 2:
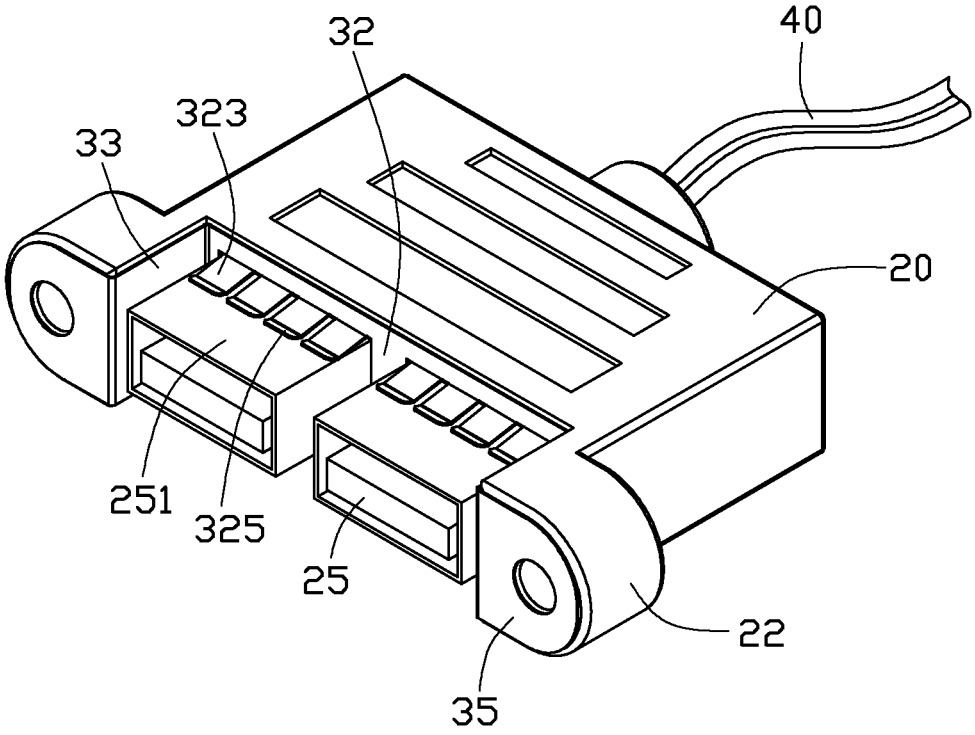
FIG. 2 is an assembled, isometric view of the USB connector of FIG. 1.
Figure 3:
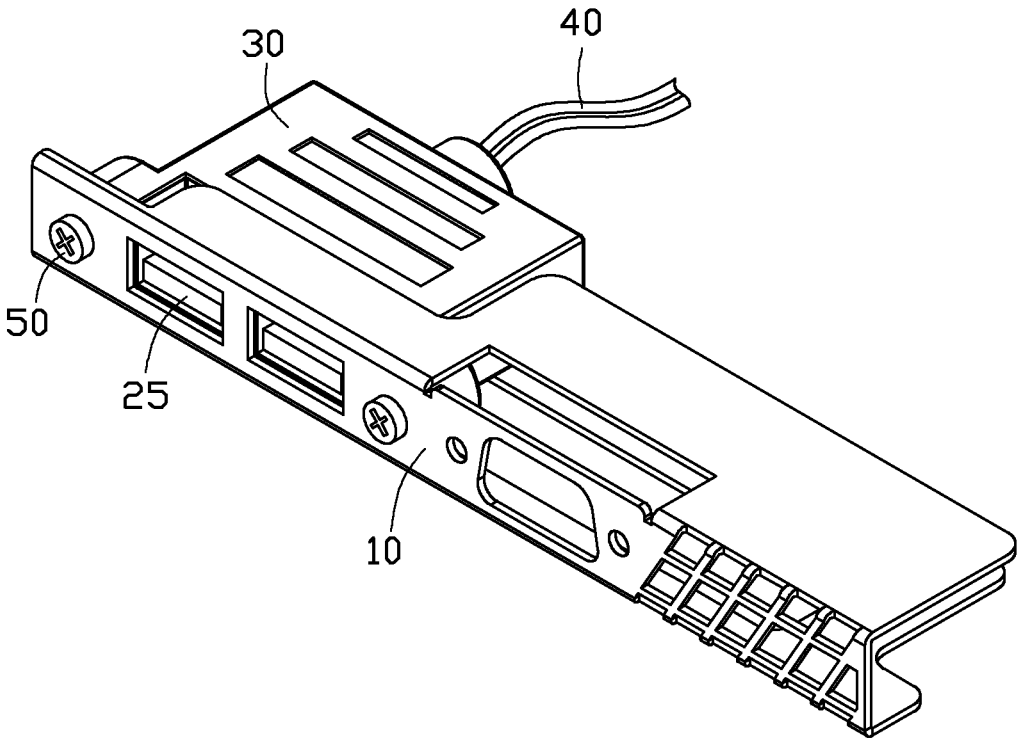
FIG. 3 is an assembled, isometric view of FIG. 1.

FIGS. 2 and 3 show that in assembly, the main body 20 is placed behind the conductive member 30. The USB interfaces 25 respectively extend through the openings 322, until the base tab 32 abuts against the sidewall 211, the extension tabs 33 respectively abut against the end walls 212, and the connection tabs 35 respectively abut against front sides of the fastening portions 22. The resilient tabs 323 deformably abut against housings 251 of the USB interfaces 25, to engage the engaging portion 31 with the main body 20. The connection tabs 35 abut against the enclosure 10 and the USB interfaces 25 are exposed through the openings 12. Two screws 50 extend through the through holes 11 and the through holes 352, and engage in the locking holes 221. Therefore, the USB connector is fastened to the enclosure 10.

The resilient tabs 323 of the conductive member 30 touch the housings 251 of the USB interfaces 25, the connection tabs 35 of the conductive member touch the enclosure 10, and the enclosure 10 is connected to ground, which forms a grounding path. Therefore, electromagnetic waves generated by the cables 40 decrease.

Even though numerous characteristics and advantages of the embodiments have been set forth in the foregoing description, together with details of the structure and the functions of the embodiments, the disclosure is illustrative only, and changes may be made in details, especially in the matters of shape, size, and arrangement of parts within the principles of the embodiments to the full extent indicated by the broad general meaning of the terms in which the appended claims are expressed.

What is claimed is:

1. A universal serial bus (USB) connector, comprising:

a main body comprising at least one USB interface; and a conductive member comprising an engaging portion engaging with the main body and abutting against each housing of the at least one USB interface, and at least a connection tab extending from the engaging portion;

wherein the conductive member defines at least one opening, corresponding to the at least one USB interface; the at least one USB interface extends through the at least one opening; a plurality of resilient tabs extends from top and bottoms sides bounding each opening toward the corresponding USB interface and deformedly abuts against the housing of the corresponding USB interface; a slot is defined in a front side of the main body, the slot comprises a sidewall and two end walls, the at least one USB interface is connected to the sidewall, the conductive member comprises a base tab abutting against the sidewall, and two extension tabs extending forward from opposite ends of the base tab and abutting against the end walls, and the at least one opening is defined in the base tab.

2. The USB connector of claim 1, wherein the number of the connection tabs is two, the connection tabs respectively extend from front sides of the extension tabs, away from each other, a first through hole is defined in each connection tab, the main body further comprises two fastening portions at opposite sides of the slot, a locking hole is defined in each fastening hole.

3. The USB connector of claim 1, wherein a slanting tab extends from a front end of each resilient tab away from the corresponding USB interface.

* * * * *